US012540485B1

(12) United States Patent
Hogan

(10) Patent No.: US 12,540,485 B1
(45) Date of Patent: Feb. 3, 2026

(54) TENT FOR CHILDREN

(71) Applicant: Wilder Concepts, LLC, Crested Butte, CO (US)

(72) Inventor: Sara H. Hogan, Crested Butte, CO (US)

(73) Assignee: Wilder Concepts, LLC, Crested Butte, CO (US)

( * ) Notice: Subject to any disclaimer, the term of this patent is extended or adjusted under 35 U.S.C. 154(b) by 0 days.

(21) Appl. No.: 19/278,773

(22) Filed: Jul. 24, 2025

Related U.S. Application Data

(60) Provisional application No. 63/679,072, filed on Aug. 2, 2024.

(51) Int. Cl.

| | |
|---|---|
| ***E04H 15/56*** | (2006.01) |
| ***E04H 15/32*** | (2006.01) |
| ***E04H 15/42*** | (2006.01) |
| ***E04H 15/54*** | (2006.01) |
| ***E04H 15/58*** | (2006.01) |
| ***E04H 15/64*** | (2006.01) |

(52) U.S. Cl.
CPC ..... *E04H 15/56* (2013.01); *E04H 15/324* (2013.01); *E04H 15/425* (2013.01); *E04H 15/54* (2013.01); *E04H 15/58* (2013.01); *E04H 15/64* (2013.01)

(58) Field of Classification Search
None
See application file for complete search history.

(56) References Cited

U.S. PATENT DOCUMENTS

| | | | | |
|---|---|---|---|---|
| 2,627,864 | A * | 2/1953 | Baker | E04H 15/56 135/120.1 |
| 4,766,918 | A * | 8/1988 | Odekirk | E04H 15/30 441/38 |
| D389,677 | S | 1/1998 | Hebner et al. | |
| 6,644,329 | B2 | 11/2003 | Tomason | |
| 7,191,788 | B2 | 3/2007 | Holub et al. | |
| D550,803 | S | 9/2007 | Brumbach et al. | |
| 8,651,124 | B2 | 2/2014 | Damas | |
| D737,919 | S | 9/2015 | Wienke | |
| 9,609,938 | B1 * | 4/2017 | Wilson | A45F 3/04 |
| 9,777,508 | B2 | 10/2017 | Kalvani | |
| 10,443,263 | B2 * | 10/2019 | LaHood | E04H 15/64 |
| 10,450,772 | B2 * | 10/2019 | LaHood | E04H 15/56 |

(Continued)

FOREIGN PATENT DOCUMENTS

| | | | |
|---|---|---|---|
| DE | 102022100724 | A1 | 7/2022 |
| EP | 3402947 | A1 | 11/2018 |

(Continued)

*Primary Examiner* — David R Dunn
*Assistant Examiner* — Danielle Jackson
(74) *Attorney, Agent, or Firm* — Patent Engineering, LLC; Stephen B. Katsaros

(57) ABSTRACT

A tent for children includes a base with a top, bottom, and border. A collapsible shelter is formed with the base, comprising vertical panels, an upper canopy, and poles. A sleeping pad is removably attached to the bottom of the base, with a perimeter outwardly offset from the base border to prevent child entrapment. The tent may include a removable floor panel secured by a zipper mechanism, an access door, corner webbings with pass-through fittings, and storage pockets. The design provides a safe and versatile sleeping solution for children in various environments.

18 Claims, 10 Drawing Sheets

(56) References Cited

U.S. PATENT DOCUMENTS

| | | | | |
|---|---|---|---|---|
| 11,091,930 | B2 * | 8/2021 | Grenier | E04H 15/56 |
| 11,140,997 | B2 | 10/2021 | Mallory et al. | |
| 11,280,108 | B1 * | 3/2022 | Szepi | A47C 17/64 |
| 11,617,450 | B2 | 4/2023 | Mallory et al. | |
| 11,761,229 | B1 * | 9/2023 | Hale | E04H 15/54 135/115 |
| 11,933,063 | B2 * | 3/2024 | Lingbloom | H05B 3/34 |
| D1,035,809 | S | 7/2024 | Clute et al. | |
| 12,048,381 | B2 | 7/2024 | Mallory et al. | |
| 12,258,771 | B2 | 3/2025 | Licau | |
| 2003/0024560 | A1 | 2/2003 | Tomason | |
| 2007/0272289 | A1 * | 11/2007 | Cooper | E04H 15/56 135/137 |
| 2009/0025766 | A1 | 1/2009 | Kline | |
| 2010/0170549 | A1 * | 7/2010 | Bell | E04H 15/56 428/196 |
| 2011/0061701 | A1 | 3/2011 | Perez | |
| 2012/0125390 | A1 | 5/2012 | Damas | |
| 2015/0027505 | A1 * | 1/2015 | Thompson | E04H 15/10 135/92 |
| 2016/0017631 | A1 * | 1/2016 | Gilmore | E04H 15/324 135/143 |
| 2016/0286989 | A1 * | 10/2016 | Marcello | D05B 11/005 |
| 2017/0198492 | A1 | 7/2017 | Kalvani | |
| 2018/0223559 | A1 * | 8/2018 | Lim | E04H 15/42 |
| 2022/0047092 | A1 | 2/2022 | Mallory et al. | |
| 2022/0202200 | A1 | 6/2022 | Mallory et al. | |
| 2022/0225788 | A1 | 7/2022 | Guo et al. | |
| 2024/0200356 | A1 * | 6/2024 | Dong | E04H 15/56 |

FOREIGN PATENT DOCUMENTS

| | | | | |
|---|---|---|---|---|
| KR | 200334623 | Y1 * | 11/2003 | E04H 15/56 |
| KR | 20060057496 | A * | 5/2006 | E04H 15/001 |
| KR | 101934230 | B1 * | 12/2018 | E04H 15/20 |
| TW | M259529 | U | 3/2005 | |
| WO | 2017123263 | A1 | 7/2017 | |

* cited by examiner

TENT FOR CHILDREN

CROSS-REFERENCE TO RELATED APPLICATION

This application claims priority to U.S. Provisional Application No. 63/679,072 entitled "Packable Kids' Tent with Improved Features," filed Aug. 2, 2024, by Inventor Sara H. Hogan, which is hereby incorporated by reference in its entirety.

TECHNICAL FIELD

The present disclosure relates to portable shelters, and more particularly to a tent designed for safe and convenient use by children, featuring removable components and an external sleeping pad attachment.

BACKGROUND

Portable shelters and tents have long been used for outdoor recreation and temporary accommodation. These structures typically consist of fabric walls supported by poles or frames, protecting them from the elements. For children, specialized portable shelters can offer safe and comfortable spaces for play, rest, or sleep during travel or outdoor activities. Conventional designs often focus on lightweight materials, ease of assembly, and compact storage to enhance portability and convenience for families on the go.

SUMMARY

The present disclosure relates to a tent for children, which can be used for various applications such as indoor and outdoor sleeping arrangements, travel accommodations, and safe play spaces. This tent offers advantages, including enhanced safety features to prevent child entrapment, improved hygiene through removable components, and a compact, lightweight design for easy transport. The primary objectives are to provide a versatile, child-friendly sleeping solution that addresses common safety concerns while offering convenience for caregivers in various settings.

In an illustrative configuration, a tent for children may include a base comprising a top, a bottom oppositely disposed to the top, and a border externally formed at the bottom. The tent may include a collapsible shelter formed with the base, the collapsible shelter comprising a plurality of vertical panels adjoined to the border of the base, an upper canopy attached to the plurality of vertical panels, and a pair of poles, each pole extending between, and coupled to the base and the upper canopy. A sleeping pad may be removably attached to the bottom of the base, the sleeping pad comprising an upper surface attached to the bottom of the base, a bottom surface oppositely disposed to the upper surface, and a perimeter enclosing the upper surface and the bottom surface and coupled to the plurality of vertical panels. The perimeter of the sleeping pad may be outwardly offset to the border of the base by a predefined surface area to prevent entrapment of a child between the bottom of the base and the sleeping pad.

In an illustrative configuration, a method of assembling a tent for children may include providing a base comprising a top, a bottom oppositely disposed to the top, and a border externally formed at the bottom. The method may include forming a collapsible shelter with the base, the collapsible shelter comprising a plurality of vertical panels adjoined to the border of the base, an upper canopy attached to the plurality of vertical panels, and a pair of poles, each pole extending between and coupled to the base and the upper canopy. The method may further include removably attaching a sleeping pad to the bottom of the base, the sleeping pad comprising an upper surface attached to the bottom of the base, a bottom surface oppositely disposed to the upper surface, and a perimeter enclosing the upper surface and the bottom surface, and coupled to the plurality of vertical panels, wherein the perimeter of the sleeping pad is outwardly offset to the border of the base by a predefined surface area to prevent entrapment of a child between the bottom of the base and the sleeping pad.

In an illustrative configuration, a tent for children may include a base comprising a top, a bottom oppositely disposed to the top, and a border externally formed at the bottom. The tent may include a collapsible shelter formed with the base, the collapsible shelter comprising a plurality of vertical panels adjoined to the border of the base, an upper canopy attached to the plurality of vertical panels, and a pair of poles, each pole extending between, and coupled to the base and the upper canopy. The tent may include a sleeping pad removably attached to the bottom of the base and a removable floor panel secured within the top of the base using a first zipper mechanism. The first zipper mechanism may include a first zipper chain and a first slider sliding thereon, the first zipper chain comprising a first terminal to house a zipper slider, and a second terminal, wherein the first zipper chain at the second terminal extends over the first terminal by a predefined distance to prevent access to the zipper slider.

Further areas of applicability of the present disclosure will become apparent from the detailed description provided hereinafter. It should be understood that the detailed description and specific examples while indicating various configurations, are intended for purposes of illustration only and are not intended to necessarily limit the scope of the disclosure.

BRIEF DESCRIPTION OF THE DRAWINGS

The accompanying figures of the drawing, which are included to provide a further understanding of the general configurations of the system/method, are incorporated in and constitute a part of this specification. These illustrative configurations of the system/method, together with the detailed description, explain the principles of the system. No attempt is made to show structural details in more detail than is necessary for a fundamental understanding of the system and the various ways in which it is practiced. The following figures of the drawing include.

Figure 1:
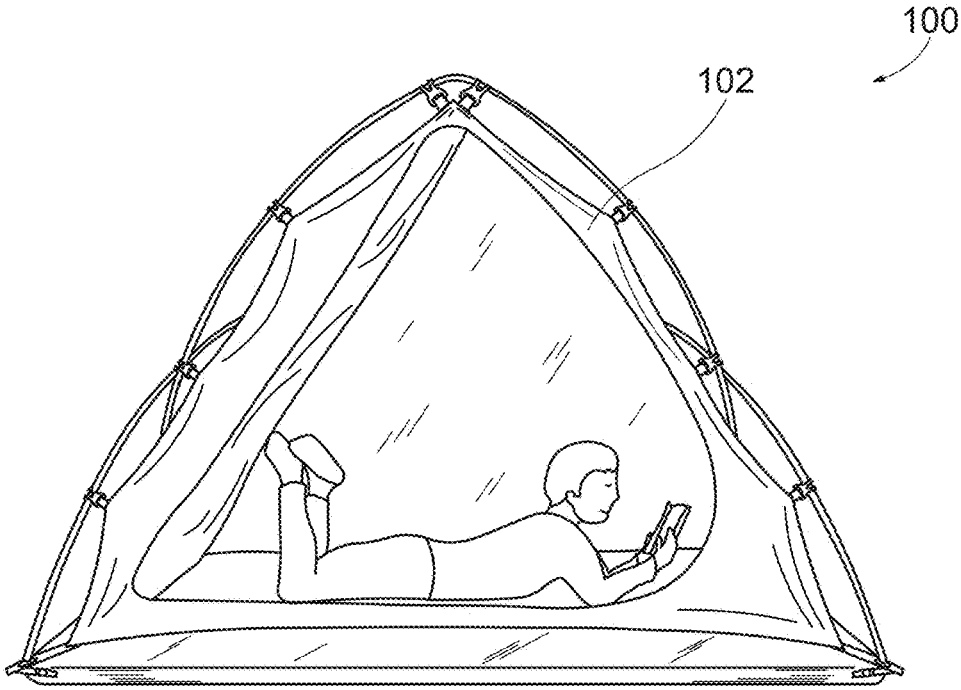
FIG. 1 illustrates a schematic view of a tent with a sleeping pad.

In the appended figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label. Where the reference label is used in the specification, the description is applicable to any one of the similar components having the same reference label.

DETAILED DESCRIPTION

Illustrative configurations are described with reference to the accompanying drawings. Wherever convenient, the same reference numbers are used throughout the drawings to refer to the same or like parts. While examples and features of disclosed principles are described herein, modifications, adaptations, and other implementations are possible without departing from the spirit and scope of the disclosed configurations. It is intended that the following detailed description be considered exemplary only, with the true scope and spirit being indicated by the following claims.

Current tents for children often present challenges in terms of safety, portability, and ease of use. Many existing products lack comprehensive safety features, can be bulky and difficult to transport, or may prove challenging for caregivers to set up and use efficiently. Traditional travel tents and play tents often have design limitations that can create entrapment risks or may not be suitable for a wide range of environments. Additionally, these solutions may not provide the necessary flexibility for various travel scenarios or home use. There is a need for an improved tent for children that prioritizes safety while offering enhanced portability and a user-friendly design.

The tent for children disclosed herein addresses the need for a safe, versatile, and easily transportable sleeping solution for young children. The tent may include a collapsible shelter structure with an integrated base, vertical panels, and an upper canopy supported by poles. A removable floor panel secures the base interior through a specialized zipper mechanism. An external sleeping pad attaches to the bottom of the base, extending beyond the tent footprint to eliminate entrapment risks. The tent incorporates multiple safety features, including child-safe interior pockets, a D-shaped access door with optional locking mechanisms, and exterior pockets for parental monitoring devices. The tent assembly method involves positioning the base, erecting the collapsible shelter, and attaching the sleeping pad to it. The tent achieves a compact packed volume of approximately 954 cubic inches with a total weight of approximately 6 pounds, making the tent 102 highly portable for various travel and accommodation scenarios. The modular design of the tent allows for easy cleaning and replacement of individual components, thereby enhancing hygiene and extending the product's useful lifespan.

FIG. 1 illustrates a schematic view 100 of a tent 102 for children. The tent 102 may be designed as a portable shelter specifically tailored for use in various settings. In some configurations, the tent 102 may include a collapsible structure that allows for easy setup and takedown, making the tent 102 suitable for both indoor and outdoor use. The tent 102 may incorporate safety features, such as rounded corners, soft materials, and child-safe closures, to prevent injury to the children. In certain configurations, the tent 102 may include ventilation panels or mesh windows to promote air circulation while maintaining privacy and protection. The tent 102 may be constructed using durable, lightweight materials that are resistant to wear and tear, potentially including water-resistant or waterproof fabrics to enhance versatility in different environments.

To further elaborate, the tent 102 may be configured as a lightweight and compact structure, with a packed weight of approximately 6.0 lbs. This weight specification allows for easy transportation and handling by caregivers. Additionally, the tent 102 may have a packed volume of approximately 950-960 cubic inches, enabling efficient storage and portability. In some configurations, the tent 102 may be constructed using durable, child-safe materials that can withstand both indoor and outdoor use. The structure of the tent 102 may be designed to provide stability while preventing potential entrapment hazards for children. Additionally, the tent 102 may incorporate ventilation features to ensure proper air circulation within the sleeping area. The tent 102 may be equipped with a sleeping pad 202 that extends beyond the perimeter 322 of the base 302. Such a configuration may create an offset area around the tent's footprint, preventing any risk of child entrapment between the tent 102 structure and sleeping surface. This external positioning of the sleeping pad 202 relative to the tent 102 structure enhances both safety and hygiene for children using the tent 102. The structure of the tent 102 is explained in detail hereinafter.

Figure 2:
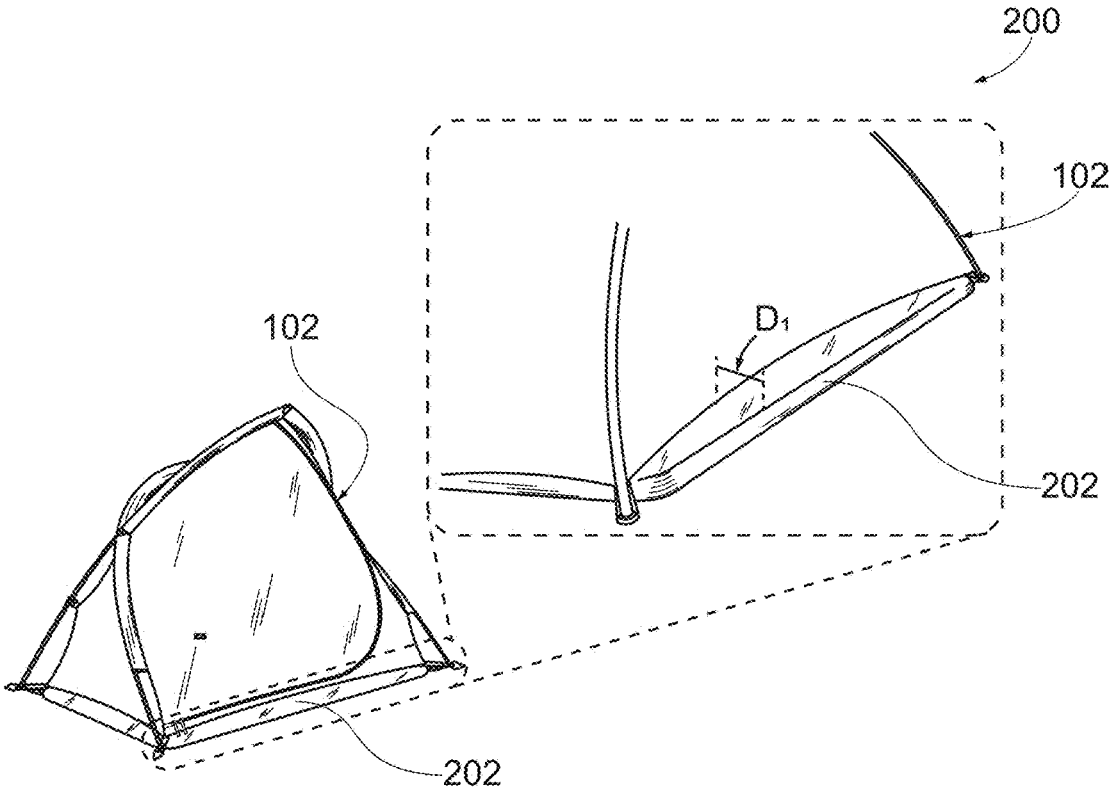
FIG. 2 illustrates a perspective view of the tent with the sleeping pad.

FIG. 2 illustrates a perspective view 200 of the tent 102. The tent 102 may be equipped with a sleeping pad 202. The sleeping pad 202 may be positioned underneath and extends beyond the footprint of the tent 102. The sleeping pad 202 may be designed to be retrofittable, allowing it to be easily attached to or detached from existing tent 102 structures and providing flexibility for various usage scenarios and enabling replacement if needed, thereby enhancing the hygiene and longevity.

The sleeping pad 202 may be outwardly offset or may extend beyond the footprint of the tent 102 by a predefined offset distance "$D_1$" (see FIG. 1). This offset configuration may create a safety zone around the perimeter 322 of the tent 102. In some configurations, the offset distance "$D_1$" may be designed to prevent any potential entrapment of a child between the base 302 and the perimeter 322 of the sleeping pad 202. The perimeter 322 of the sleeping pad 202 may also provide additional cushioning and insulation beyond the footprint of the tent 102.

With continued reference to FIG. 2, the offset distance "$D_1$" may vary depending on factors such as the overall size of the tent 102, the age range of intended users, and specific safety guidelines. In some configurations, "$D_1$" may range from about fractions of an inch to about 12 inches (more specifically one to three inches). This extended area, due to the offset distance, may serve multiple purposes, including providing a soft landing surface around the tent 102 and creating a visual boundary for children. The offset distance "$D_1$" may be designed to exceed the reach of a child's arms or legs when positioned inside the tent 102, thereby preventing the child from becoming trapped between the tent 102 structure and the edge of the sleeping pad. Additionally, the perimeter 322 may help distribute weight more evenly if a child were to lean against the side of the tent 102, potentially reducing the risk of the tent 102 tipping over. The offset area may also act as a buffer zone, keeping the child's sleeping area further away from any nearby obstacles or potential hazards in the surrounding environment. It is to be understood that the shape of the perimeter 322 may be rectangular as shown, or other geometrical shapes of a large variety (round, square, trapezoid, oval, hexagonal, etc.); when non-rectangular shaped, the term 'outwardly offset' still applies to these various shapes.

Figure 3:
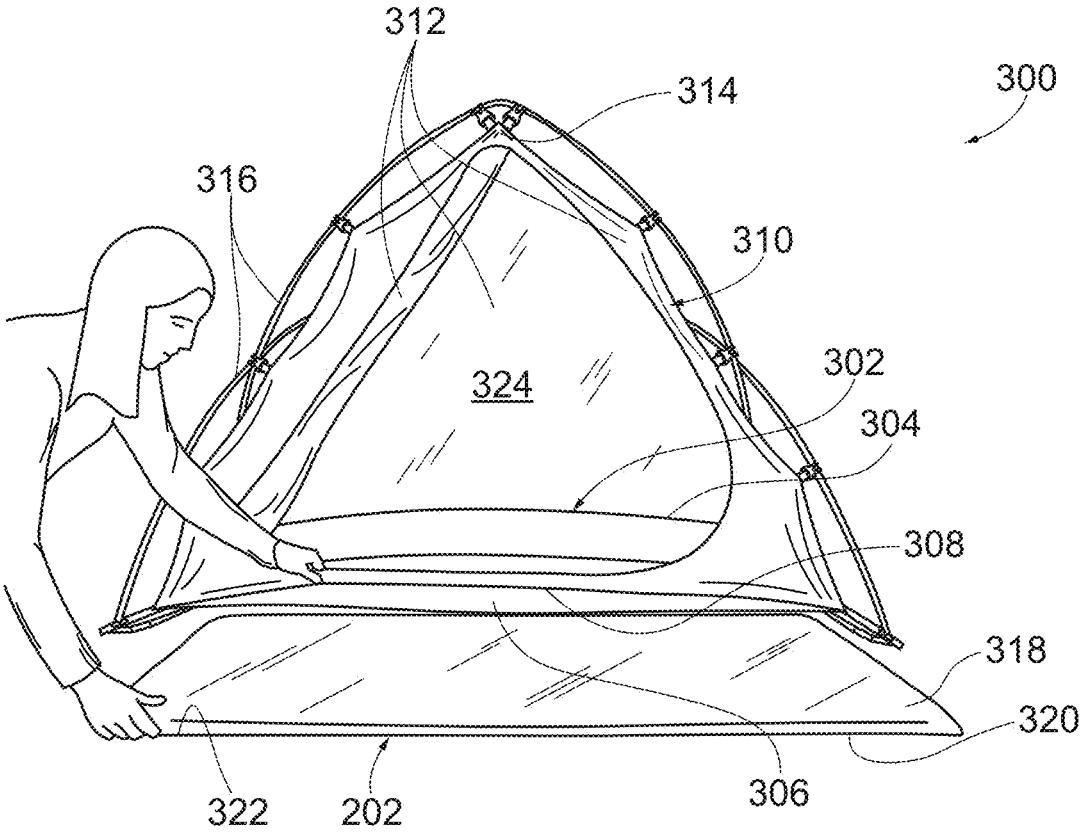
FIG. 3 illustrates a rear perspective view of a tent.

FIG. 3 illustrates a rear perspective view 300 of the tent 102. The tent 102 may include a base 302, a collapsible structure 310, and a sleeping pad 202. The base 302 may include a top 304, a bottom 306 oppositely disposed to the top 304, and a border 308 externally formed at the bottom 306. The base 302 provides a foundation for the tent 102, offering stability and support for the overall structure. The top 304 of the base 302 may serve as the floor of the tent 102 interior, while the bottom 306 interfaces with the sleeping pad 202. The border 308 may provide a defined edge for the attachment of other components, such as panels, and contribute to the structural integrity of the system.

The collapsible structure 310 may be formed with the base 302. The collapsible structure 310 may include a plurality of vertical panels 312, an upper canopy 314, and a plurality of poles 316. The plurality of vertical panels 312 may be adjoined to the border 308 of the base 302 using various methods such as stitching, zippers, or hook-and-loop fasteners, allowing for easy assembly and potential replacement if needed, and thus creating the walls of the tent 102. In some configurations, each vertical panel 312 may be designed to be both lightweight and sturdy, capable of withstanding various environmental conditions while maintaining its shape. In some configurations, the vertical panels 312 may include features such as internal pockets for storage, mesh windows for ventilation, or reflective elements for improved visibility in low-light conditions. Moreover, the design of the vertical panels 312 may also consider factors such as UV resistance, water repellency, and ease of cleaning to enhance the overall durability and functionality of the tent 102.

The upper canopy 314 may be attached to a plurality of vertical panels 312, forming the roof of the tent 102 and providing protection from the elements. In other words, the upper canopy 314 may be designed to provide comprehensive coverage and protection for the interior of the tent 102. In some configurations, the upper canopy 314 may be constructed from waterproof or water-resistant materials to shield occupants from rain or moisture. The upper canopy 314 may incorporate UV-resistant properties to offer protection from sun exposure. In some configurations, the upper canopy 314 may feature a double-layer design, with an inner layer for insulation and an outer layer for weather protection. The upper canopy 314 may include ventilation features such as mesh panels or adjustable vents to promote air circulation and reduce condensation inside the tent 102. In some implementations, the upper canopy 314 may be detachable or interchangeable, allowing for customization based on weather conditions or user preferences.

The plurality of poles 316 may extend between and may be coupled to the base 302 and the upper canopy 314, providing the structural framework that maintains the shape of the tent 102. The plurality of poles 316 may be constructed from lightweight yet durable materials such as aluminum alloy or fiberglass. In some configurations, the plurality of poles 316 may feature a segmented design, allowing for easy assembly and disassembly. The plurality of poles 316 may incorporate shock-cord technology to facilitate quick setup and prevent loss of individual segments. In some configurations, the plurality of poles 316 may be color-coded or numbered to simplify the assembly process for caregivers. The plurality of poles 316 may be designed to create an asymmetrical structure, providing enhanced headroom and interior space while maintaining stability. In some implementations, the plurality of poles 316 may feature reinforced end tips to prevent wear and ensure secure attachment to the base 302 and upper canopy 314. The arrangement and number of the plurality of poles 316 may vary depending on the specific tent 102 model and size, potentially including additional support poles for larger configurations or more challenging weather conditions.

The sleeping pad 202 may be attached to the bottom 306 of the base 302. The sleeping pad 202 may include an upper surface 318 attached to the bottom 306 of the base 302, a bottom surface 320 oppositely disposed to the upper surface 318, and a perimeter 322 attached to the upper surface 318 and bottom surface 320. In an illustrative configuration, the perimeter 322 of the sleeping pad 202 may be outwardly offset to the border 308 of the base 302 by a predefined offset distance "$D_1$" (see FIG. 1). This offset design enables the confinement of the base 302 within the pad 202, thereby preventing entrapment risk for children, enhancing the safety features of the tent 102. Such a configuration of the sleeping pad 202 may provide an important safety feature for children using the tent 102.

In an illustrative configuration, by extending beyond the border 308 of the base 302, the sleeping pad 202 creates a buffer zone around the tent 102. The buffer zone may prevent a child from becoming trapped or entangled between the tent 102 base 302 and the edge of the sleeping surface. In some configurations, the offset distance "$D_1$" may be designed to exceed the reach of a child's arms or legs towards the perimeter 322, thereby further reducing the risk of entanglement of the tent 102 with the sleeping pad 202. Additionally, the smooth transition from the border 308 of the base 302 to the sleeping pad 202 may minimize the likelihood of a child catching clothing or limbs on any edges or gaps. This design approach may also discourage children from attempting to squeeze into potentially hazardous spaces between the tent 102 and the sleeping surface, as the continuous padded area provides a clear boundary for the safe sleeping zone.

In some configurations, the plurality of vertical panels 312 may include an interior surface 324 and an exterior surface 326 (refer to FIGS. 5-7) facing the interior of the tent 102. The interior surface 324 may provide a smooth, child-friendly surface within the tent 102. Additionally, the tent 102 may include external pockets (not shown) attached to the exterior surface 326 of the vertical panels 312. These external pockets may be designed to hold baby monitors or other devices, allowing for convenient access and use by caregivers while maintaining a safe interior environment for children.

Figure 4:
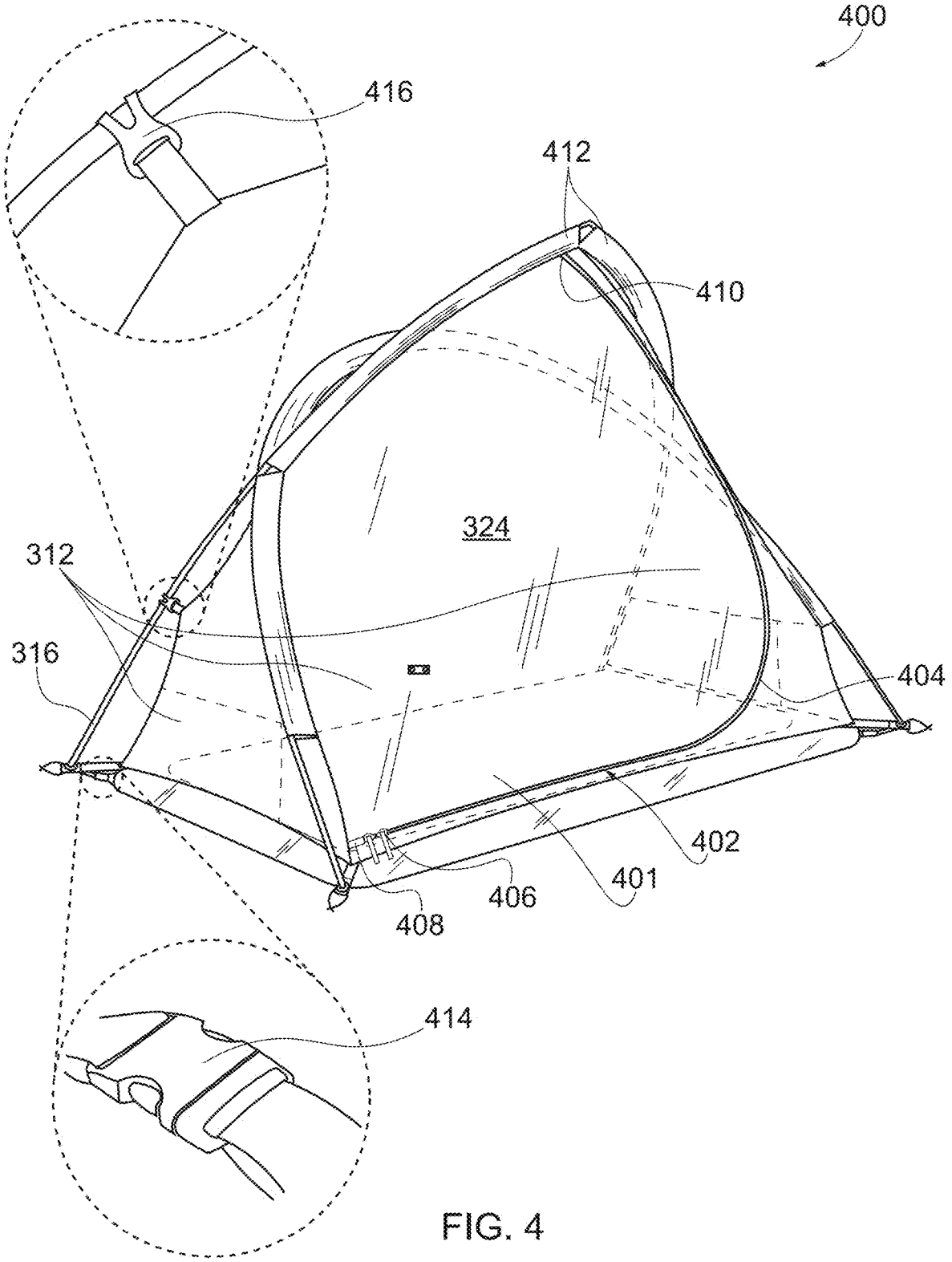
FIG. 4 illustrates a perspective view of the tent with an access door.

FIG. 4 illustrates a perspective view 400 of the tent 102. The tent 102 may include an access door 401 removably formed with one of the plurality of vertical panels 312. The access door 401 may be secured using a door zipper mechanism 402. The tent 102 may further include a sleeve 412 integrated with the exterior surface 326 of the vertical panel 312. The tent 102 may further include first-type fasteners 414. The first-type fasteners 414 may be configured to removably adjoin the sleeping pad 202 to the base 302. Additionally, the tent 102 may include second-type fasteners 416. The second-type fasteners 416 may secure the vertical panels 312 to the poles 316 along their length. As used herein, the phrase 'removably adjoin' may also mean that the sleeping pad 202 is against and/or attached to the base 302. In some configurations, the sleeping pad 202 is a structure to support the base 302.

The access door 401 may be secured using a door zipper mechanism 402. The access door 401 may be designed to form a D-shape when opened, providing a wide and easily accessible entrance to the tent 102. This D-shaped configuration may be achieved through the strategic placement of the door zipper mechanism 402 along the vertical and curved edges of the access door 401. When fully unzipped, the access door 401 may swing open, creating a semi-circular opening that resembles the curved portion of the letter "D". The straight edge of the "D" may be formed by the vertical side of the tent 102, while the arc of the opened access door 401 may create the curved portion. This D-shaped design may offer several advantages, including a generous opening for easy entry and exit, improved visibility into the tent 102 interior, enhanced airflow when the door is open, and/or decrease trip hazard compared to other style doors.

The door zipper mechanism 402 may include a door zipper chain 404 and a door slider 406 that moves along the door zipper chain 404. The door zipper chain 404 may include a first zipper end 408 and a second zipper end 410. In some configurations, either the first zipper end 408 or the second zipper end 410 may be equipped with a zipper garage to enclose the door slider 406 when the access door 401 is fully closed or opened. This zipper garage feature provides an additional safety element by preventing children from accessing the door slider 406, which could potentially be a choking hazard or allow unauthorized opening of the tent 102. The zipper garage may be constructed from the same material as the vertical panels 312 or may utilize a reinforced fabric to withstand repeated use. In certain implementations, the zipper garage may incorporate a small overlap that requires adult dexterity to access, further enhancing the child safety configurations of the door design while maintaining ease of use for caregivers.

In an illustrative configuration, the exterior surface 326 of the vertical panel 312 may be integrated with a sleeve 412. The sleeve 412 may be designed to accommodate and secure various components of the tent 102 structure. In some configurations, the sleeve 412 may serve as a guide or channel for the poles 316, facilitating smooth insertion and removal during the assembly and disassembly of the tent 102. The sleeve 412 may be constructed from durable, reinforced material to withstand repeated use and potential stress points. In certain configurations, the sleeve 412 may incorporate elastic properties to maintain tension on the poles 316, enhancing the overall stability of the tent 102 structure.

The tent 102 may further include first-type fasteners 414. The first-type fasteners 414 may be configured to adjoin the sleeping pad 202 to the base 302 removably. In some configurations, the first-type fasteners 414 may be positioned at strategic locations along the interface between the base 302 and the sleeping pad 202 to ensure secure attachment while allowing for easy removal when needed. The design of the first-type fasteners 414 may enable caregivers to quickly detach the sleeping pad 202 for cleaning or replacement, enhancing the hygiene and maintenance configurations of the tent 102.

The first-type fasteners 414 may include various types of secure and readily releasable mechanisms. In some configurations, the first-type fasteners 414 may incorporate side-release (SR) buckles, which provide a quick and reliable connection method. These SR buckles may feature a male end looped with the sleeping pad 202, allowing for swift attachment and detachment with a simple squeeze motion with a female end looped or adjoined with the tent 102. Alternatively, the first-type fasteners 414 may utilize hook-and-loop fasteners, snap buttons, or toggle closures, each offering different levels of adjustability and ease of use. The selection of fastener type may depend on factors such as the tent's intended use environment, frequency of pad removal, and ease of operation for caregivers.

Additionally, the tent 102 may include second-type fasteners 416. The second-type fasteners 416 may secure the vertical panels 312 to the poles 316 along their length, providing additional stability to the tent 102 structure. In some cases, the second-type fasteners 416 may be designed to allow for adjustable tensioning of the vertical panels 312. The second-type fasteners 416 may include various designs to attach the vertical panels 312 to the poles 316 securely. In some configurations, the second-type fasteners 416 may include plastic clips that snap onto the poles 316 and may be adjoined to the vertical panels 312 with fabric loops. Alternatively, the second-type fasteners 416 may utilize adjustable straps with buckles that wrap around both the poles 316 and the vertical panels 312, allowing for tension adjustment. In other implementations, the second-type fasteners 416 may feature hook-and-loop strips attached to both the poles 316 and vertical panels 312 for a customizable fit. The second-type fasteners 416 may also include sliding mechanisms that can be repositioned along the length of the poles 316 to optimize panel placement. In some cases, the second-type fasteners 416 may incorporate elastic cord loops that stretch over pole segments, providing a snug yet flexible attachment.

The tent 102 incorporates a structural framework that optimally balances stability with portability. Such balance is achieved through the strategic assembly of the base 302, the sleeping pad 202, and the plurality of poles 316, which together distribute structural forces evenly throughout the tent 102. The design enables the tent 102 to maintain structural integrity while remaining lightweight and easily transportable (explained elsewhere herein).

Figure 5:
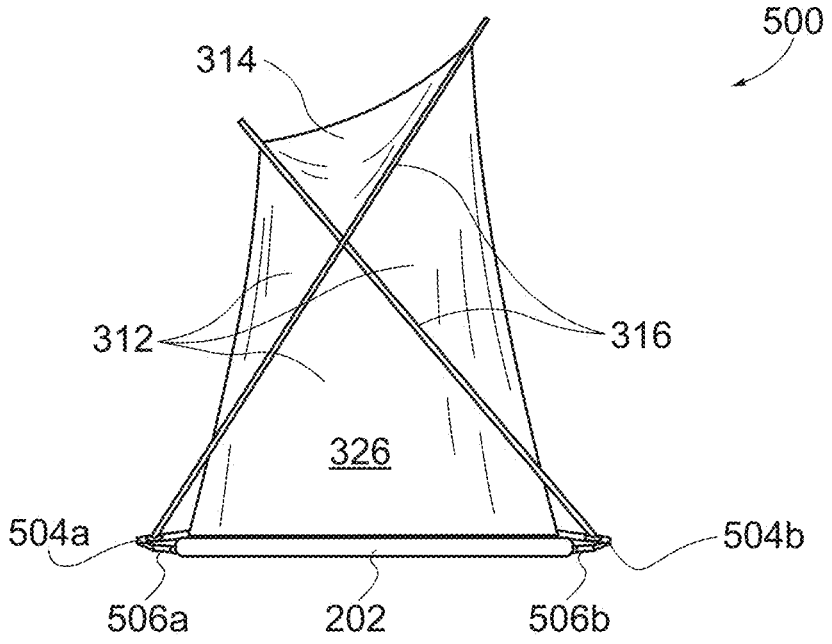
FIG. 5 illustrates a right-side view of a tent structure.
Figure 6:
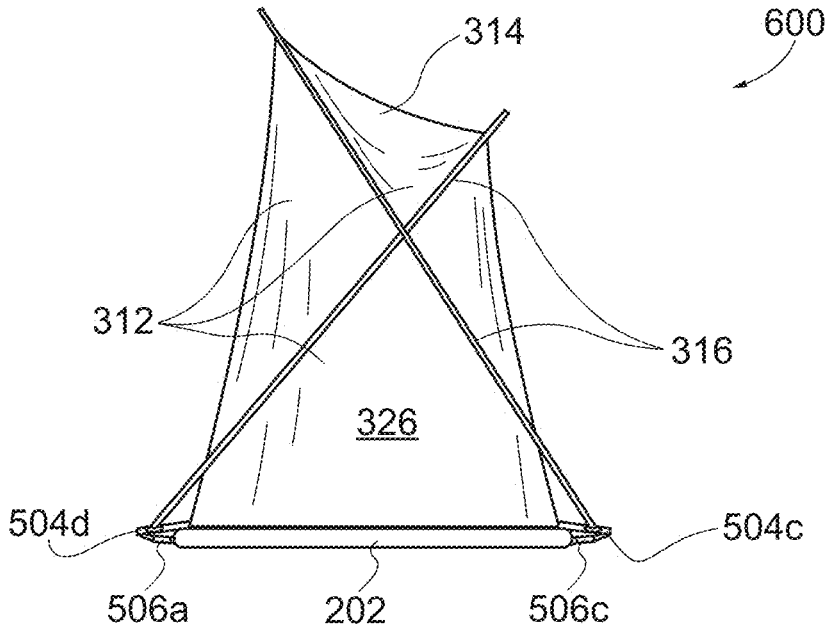
FIG. 6 illustrates a left-side view of a tent structure.

FIG. 5 illustrates a right-side view 500 of a tent 102 structure, and FIG. 6 illustrates a left-side view 600 of the tent 102 structure. As explained earlier, the right-side view 500 may include a plurality of vertical panels 312 forming the walls of the tent 102, with an exterior surface 326 visible thereon. Further, the plurality of vertical panels 312 may be supported by a plurality of poles 316 that extend from the base 302 to the upper canopy 314, creating the tent's framework. The poles 316 may intersect to form an X-shape when viewed from the side.

In an illustrative configuration, with continued reference to FIGS. 5-6, the tent 102 may include a plurality of first corner webbings 504*a*, 504*b*, 504*c*, and 504*d*. The plurality of first corner webbings 504*a*, 504*b*, 504*c*, and 504*d* may extend from the corners of the tent 102, or, precisely, extend from the corners of the base 302. The plurality of first corner webbings 504*a*, 504*b*, 504*c*, and 504*d* may provide anchor points for the footwork of the tent 102. The plurality of first corner webbings 504*a*, 504*b*, 504*c*, and 504*d* may be constructed from durable, high-strength materials such as nylon or polyester webbing to withstand tension and environmental stresses.

In an illustrative configuration, the plurality of first corner webbings 504*a*, 504*b*, 504*c*, and 504*d* may incorporate reinforced stitching or additional layers at stress points to enhance durability. The plurality of first corner webbings 504*a*, 504*b*, 504*c*, and 504*d* may aid in the attachment of the sleeping pad 202 to the base 302. In certain configurations, the first corner webbings 504*a*, 504*b*, 504*c*, and 504*d* may feature adjustable lengths, allowing for customization of the tent's tension and shape to accommodate various terrain conditions.

In an illustrative configuration, the tent 102 may include a plurality of second corner webbings 506*a*, 506*b*, 506*c*, and 506*d*. The plurality of second corner webbings 506*a*, 506*b*, 506*c*, and 506*d* may extend from the corners of the sleeping pad 202. The plurality of second corner webbings 506*a*, 506*b*, 506*c*, and 506*d* may be designed to interface with the corresponding plurality of first corner webbings 504*a*, 504*b*, 504*c*, and 504*d* of the tent 102. The plurality of second corner webbings 506*a*, 506*b*, 506*c*, and 506*d* may be constructed from materials similar to those used for the first corner webbings, ensuring durability and strength. In some configurations, the plurality of second corner webbings 506*a*, 506*b*, 506*c*, and 506*d* may incorporate adjustable features, allowing for fine-tuning of the sleeping pad's position relative to the base 302. The connection between the plurality of first corner webbings 504*a*, 504*b*, 504*c*, and 504*d* and the plurality of second corner webbings 506*a*, 506*b*, 506*c*, and 506*d* may be facilitated by the first-type fasteners 414.

In an illustrative configuration, the plurality of second corner webbings 506*a*, 506*b*, 506*c*, and 506*d* may extend from the corners of the sleeping pad 202. The plurality of second corner webbings 506*a*, 506*b*, 506*c*, and 506*d* may be designed to interface with the corresponding plurality of first corner webbings 504*a*, 504*b*, 504*c*, and 504*d* of the tent 102, respectively, using the first-type fasteners 414. The male component of the first-type fasteners 414 may be looped with the plurality of first corner webbings 504*a*, 504*b*, 504*c*, and 504*d*, while the corresponding female component of the first-type fasteners 414 may be equipped with the plurality of second corner webbings 506*a*, 506*b*, 506*c*, and 506*d*, or vice-versa. When the male component of the first-type fasteners 414 engages with the female component of the first-type fasteners 414, the plurality of first corner webbings 504*a*, 504*b*, 504*c*, and 504*d* securely interfaces with the plurality of second corner webbings 506*a*, 506*b*, 506*c*, and 506*d* respectively, creating a robust connection between the base 302 of the tent 102 and the sleeping pad 202. The plurality of first corner webbings 504*a*, 504*b*, 504*c*, and 504*d* may serve various functions, including securing the tent 102 to the ground via stakes or guy lines, connecting the tent 102 body to the base 302, and providing attachment points for the plurality of poles 316. This is explained in detail, hereinafter.

Figure 7:
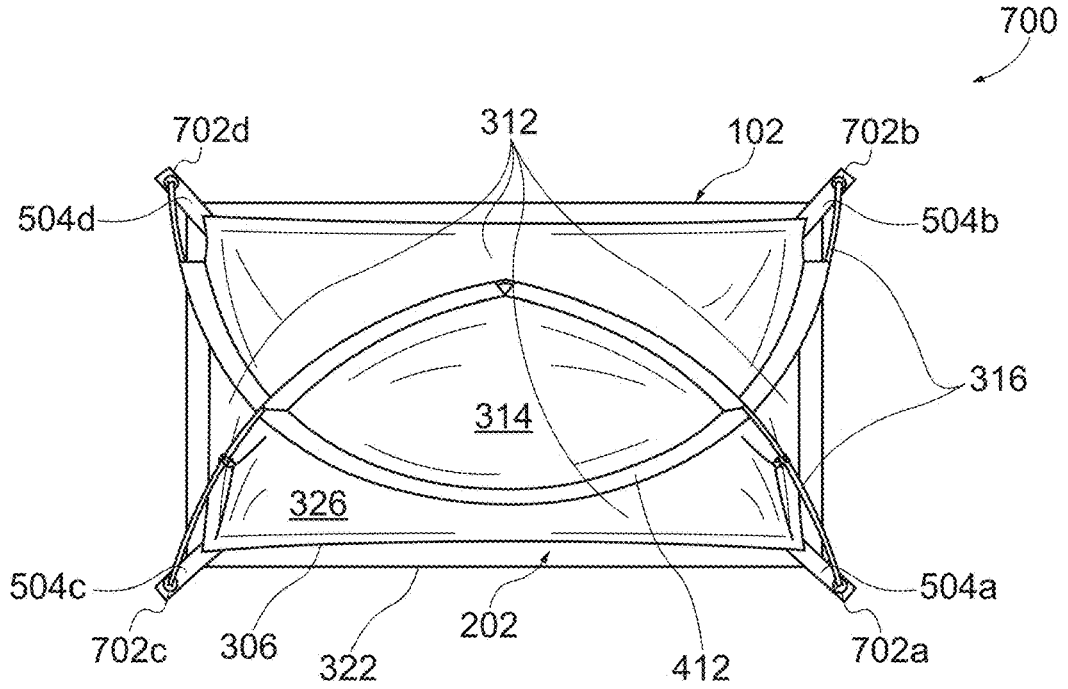
FIG. 7 illustrates a top view of the tent and sleeping pad.

FIG. 7 illustrates a top view 700 of the tent 102. As explained earlier, the tent 102 may include the plurality of poles 316 to provide structural support and define the tent's shape. Further, the tent 102 may include a plurality of first corner webbings 504*a*, 504*b*, 504*c*, and 504*d* that may extend from the corners of the base 302. Each corner webbing from the plurality of first corner webbings 504*a*, 504*b*, 504*c*, and 504*d* may be configured to allow passage ends of each pole of the plurality of poles 316 therethrough.

To allow passage of each pole of the plurality of poles 316, pass-through fittings 702*a*, 702*b*, 702*c*, and 702*d* may be formed with the plurality of first corner webbings 504*a*, 504*b*, 504*c*, and 504*d*, respectively. The pass-through fittings 702*a*, 702*b*, 702*c*, and 702*d* may be configured to accommodate and secure the ends of the poles 316. For example, at the ends of each pole may be engagement between consecutive pass-through fittings 702*a*, 702*b*, 702*c*, and 702*d*. For example, referring to FIG. 7, each pole 316 passes through two consecutive pass-through fittings 702*a*, 702*c* or 702*b*, and 702*d* via the sleeve 412.

In an illustrative configuration, the pass-through fittings 702*a*, 702*b*, 702*c*, and 702*d* may incorporate various designs, such as but not limited to socket-style receptacles with internal channels to guide insertion of the ends of the pole 316, grommet-style openings with reinforced edges to prevent tearing of the plurality of first corner webbings 504*a*, 504*b*, 504*c*, and 504*d*, or specialized clip mechanisms that secure the pole ends while allowing quick release when needed. Some configurations may feature rotating or pivoting elements to accommodate the angular positioning of poles during the setup of the tent 102. In contrast, others may include locking mechanisms that engage with corresponding features on the pole tips to prevent accidental dislodgement. The pass-through fittings 702*a*, 702*b*, 702*c*, and 702*d* may also be designed with low-profile shapes to minimize protrusions that could pose safety hazards to children using the tent 102.

This interaction between the pass-through fittings 702*a*, 702*b*, 702*c*, and 702*d* and the plurality of first corner webbings 504*a*, 504*b*, 504*c*, and 504*d* may contribute to the overall stability of the tent 102, potentially enhancing the ability to withstand wind and other external pressures. The design may allow for some flexibility in the structure while maintaining rigidity where needed, which may be particularly beneficial for a tent 102 intended for use with children.

Figure 8:
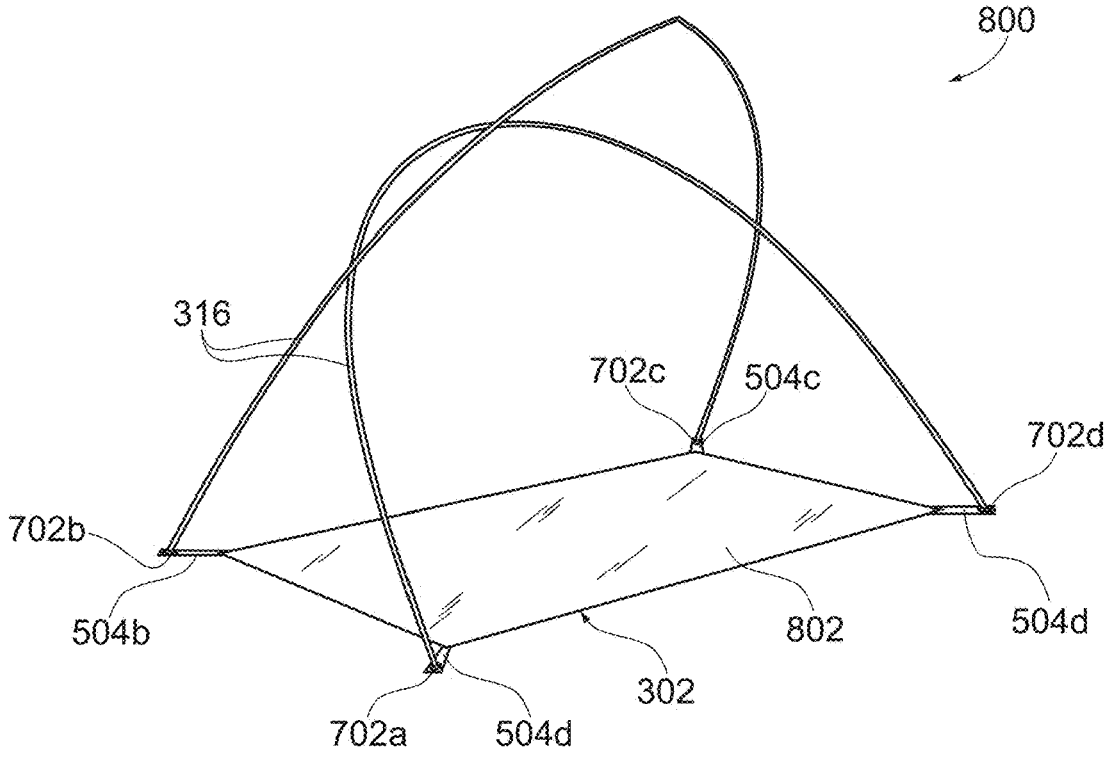
FIG. 8 illustrates an internal perspective view of the tent.

FIG. 8 illustrates an internal perspective view 800 of the tent 102 for children. The tent 102 may include a base 302 and a removable floor panel 802 removably adjoined to the base 302. The base 302 may serve as the foundation for the tent 102. The base 302 may be constructed from a durable, lightweight material such as ripstop nylon or polyester to provide stability while maintaining portability.

The removable floor panel 802 may be designed to fit securely within the top 304 of the base 302, providing a clean and comfortable surface for the child to rest on. The removable floor panel 802 may be made of soft, washable material to facilitate easy cleaning and maintenance, particularly in scenarios where children accidentally soil the interior or spill food and drinks during use, necessitating a quick and efficient cleaning solution.

In an illustrative configuration, the assembly of pass-through fittings 702*a*, 702*b*, 702*c*, and 702*d* may be integrated with the plurality of first corner webbings 504*a*, 504*b*, 504*c*, and 504*d* to create a robust structural system for the tent 102. As the poles 316 are inserted through the pass-through fittings 702*a*, 702*b*, 702*c*, 702*d*, they may create tension in the corner webbings, the collapsible structure 310, and the base 302, which in turn may help to distribute forces evenly across the tent 102.

In some configurations, the plurality of poles 316 may be customizable to accommodate various tent 102 sizes, user preferences, or specific environmental conditions. The ability to adjust pole length or curvature may allow for fine-tuning of the tent's interior space, headroom, or overall stability. Customizable poles may incorporate features such as telescoping sections, interchangeable segments of different lengths, or adjustable connection points. This adaptability in pole design may enable the tent 102 to be reconfigured for different uses, such as creating a more compact setup for travel or a more spacious arrangement for extended stays.

Figure 9:
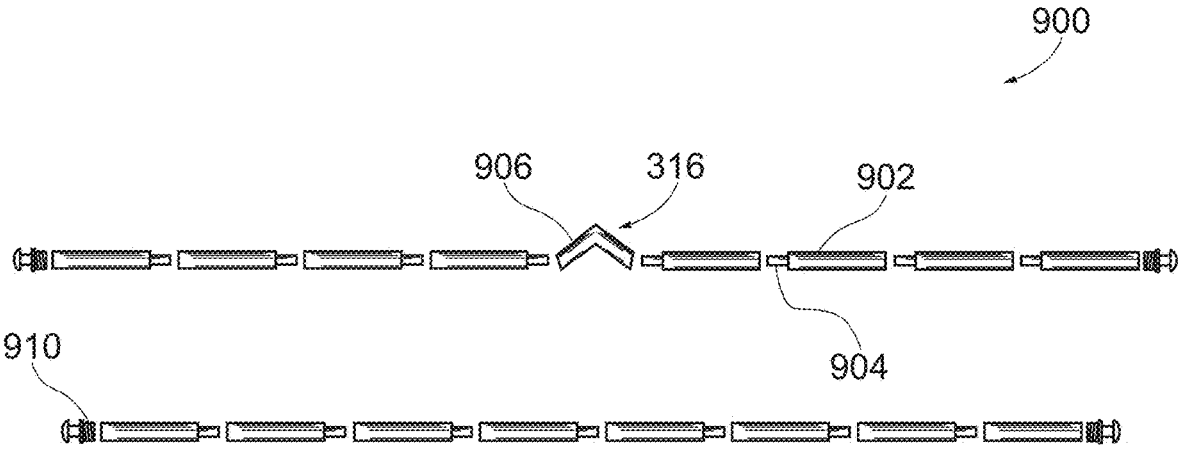
FIG. 9 illustrates a schematic view of a tent pole.

FIG. 9 shows a schematic 900 of each pole 316 in a disassembled state. Each pole 316 may be formed by a plurality of links 902 interconnected via an insert pin 904. Such a modular design may allow the poles to be easily assembled and disassembled, facilitating quick setup and takedown of the tent 102. The links 902 may be formed as hollow cylindrical segments, potentially made from the same material as the overall pole 316. The links 902 may be designed with precise dimensions to ensure a snug fit when connected, providing stability to the assembled pole 316.

Moreover, as seen in FIGS. 1-8, the plurality of poles 316 may be formed in an arc-shaped structure. To facilitate such a shape, each pole 316 may be equipped with an arc connector 906. The arc connector 906 may be a specially designed angular component that introduces a precise curve to the otherwise straight pole segments. This curvature may contribute to the overall dome-like shape of the tent 102, maximizing interior space while enhancing structural stability. In some configurations, the arc connector 906 may be positioned at a predetermined point along the length of the pole 316 to achieve an optimal balance between headroom and the overall height of the tent 102.

In an illustrative configuration, the ends of each pole 316 may be equipped with a locking tip 910. The locking tip 910 may be designed to securely engage with the pass-through fittings 702*a*, 702*b*, 702*c*, and 702*d*, ensuring that the poles remain firmly in place once the tent 102 is assembled. The locking tip 910 may include, but is not limited to, mechanisms such as a push-button or twist-lock system that allows for easy insertion and removal from the pass-through fittings 702*a*, 702*b*, 702*c*, and 702*d* while preventing accidental dislodging during use.

In some configurations, the removable floor panel 802 may be designed with safety features to prevent unauthorized access by children. Hence, the removable floor panel 802 may be equipped with a zipper mechanism configured in a way that makes reaching or manipulating the zipper mechanism complex for children. Such a configuration may help prevent children from accidentally detaching the removable floor panel 802, which could potentially lead to exposure to ground surfaces or create tripping hazards. The zipper mechanism is explained hereinafter.

Figure 10:
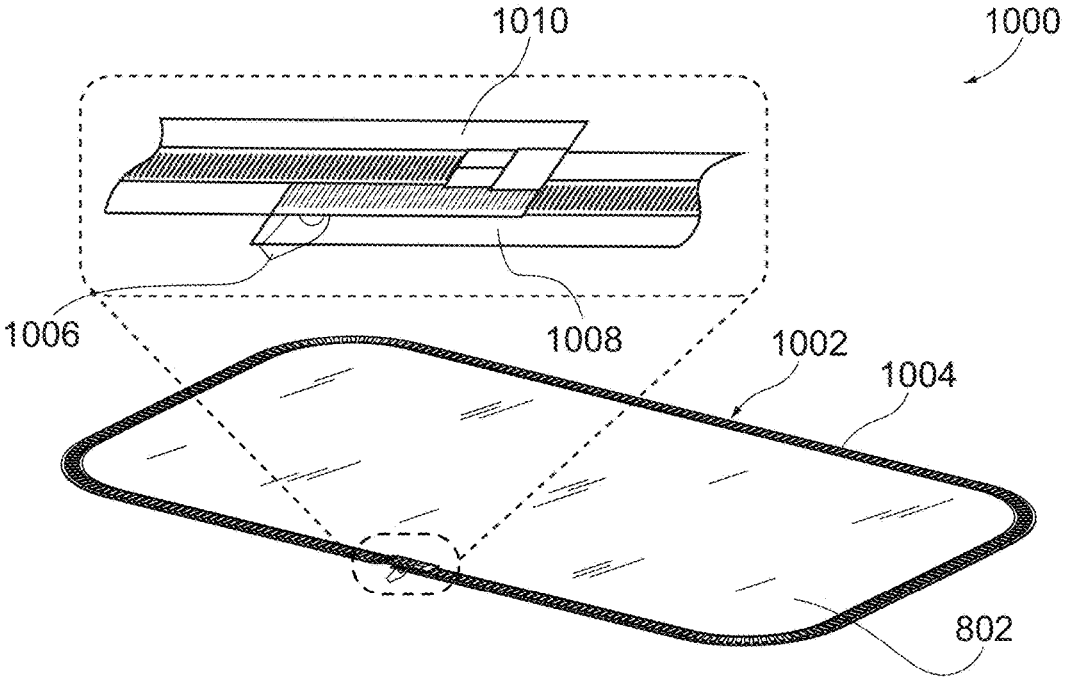
FIG. 10 illustrates a perspective view of a base zipper mechanism.

FIG. 10 illustrates a perspective view 1000 of a base zipper mechanism 1002. In an illustrative configuration, the base zipper mechanism 1002 may be designed to secure the removable floor panel 802 within the top 304 of the base 302. The removable floor panel 802 may be attached to one side of the base zipper chain 1004, while the other side of the base zipper chain 1004 may be attached to the base 302. This configuration allows for the removable floor panel 802 to be securely fastened to the base 302 when the base slider 1006 is fully closed.

The base zipper mechanism 1002 may include a base zipper chain 1004 and a base slider 1006 that slides along the base zipper chain 1004. The base zipper chain 1004 may include a first terminal 1008 and a second terminal 1010. The first terminal, 1008, may be configured to house the base slider 1006. The second terminal 1010 of the base zipper chain 1004 may extend over and overlap the first terminal 1008 by a predefined distance. This overlapping configuration may prevent access to the base slider 1006 from the interior of the tent 102, enhancing safety for children using the tent 102. The overlapping design of the second terminal 1010 over the first terminal 1008 may prevent children from accessing the base slider 1006 from inside the tent 102, reducing the risk of accidental opening or potential entrapment. Additionally, the overlapping terminals may provide a more secure closure, helping to keep the removable floor panel 802 firmly in place during use.

In an illustrative configuration, the predefined distance of overlap between the second terminal 1010 and the first terminal 1008 may be adjusted based on various factors such as the size of the tent 102, the expected age range of the children using the tent 102, or specific safety regulations. The overlap distance may be sufficient to ensure that small fingers cannot reach the base slider 1006, while still allowing adults to easily access and operate the base zipper mechanism 1002 from the exterior of the tent 102.

Figure 11:
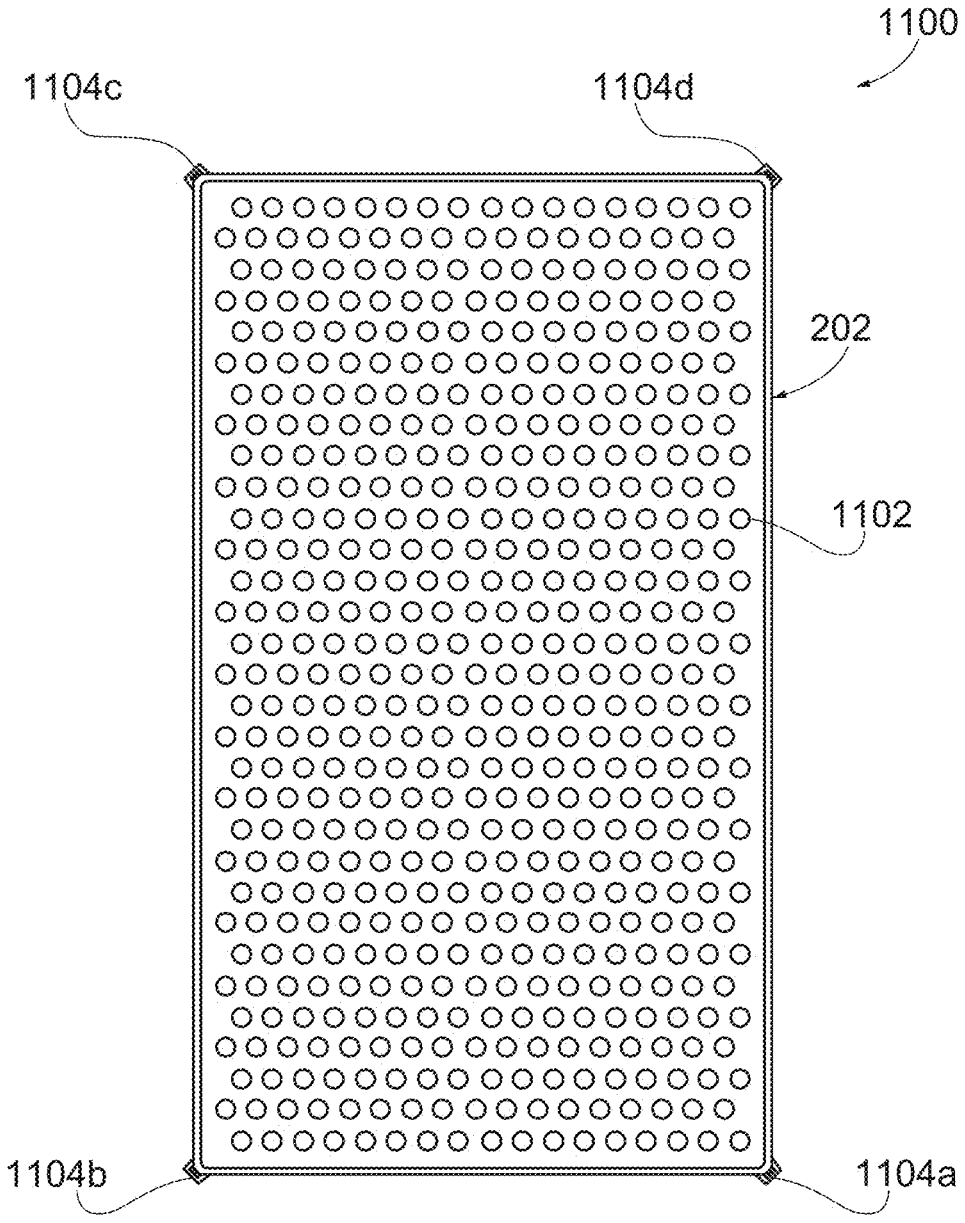
FIG. 11 illustrates a top view of a sleeping pad.

FIG. 11 illustrates a top view 1100 of a sleeping pad 202. The sleeping pad 202 may be designed to provide a comfortable and safe sleeping surface for children using the tent 102. In some configurations, the sleeping pad 202 may be constructed from durable, child-friendly materials that offer both cushioning and insulation from the ground. The pad may incorporate various features to enhance its functionality, such as a non-slip bottom surface 320 to prevent shifting during use and a waterproof or water-resistant top layer for easy cleaning. In certain configurations, the sleeping pad 202 may be foldable or rollable, facilitating compact storage and transport alongside the tent 102 components.

In an illustrative configuration, the sleeping pad 202 may include a pattern of coring holes 1102 distributed across a top surface. The coring holes 1102 may be arranged in a regular grid pattern throughout the sleeping pad 202. The coring holes 1102 may serve multiple purposes in the design of the sleeping pad 202. In some configurations, the coring holes 1102 may reduce the overall weight of the sleeping pad 202 while maintaining structural integrity. Additionally, the coring holes 1102 may enhance the flexibility of the sleeping pad 202, allowing it to conform more easily to uneven surfaces or to be folded for storage and transport. The pattern of coring holes 1102 may also improve air circulation within the sleeping pad 202, potentially enhancing comfort for the child using the tent 102.

In an illustrative configuration, the sleeping pad 202 may include loops 1104*a*, 1104*b*, 1104*c*, and 1104*d* positioned at each corner. The loops 1104*a*, 1104*b*, 1104*c*, and 1104*d* may extend outward from the corners of the sleeping pad 202 and may serve as attachment points for securing the sleeping pad 202 to the tent 102. Particularly, the loops 1104*a*, 1104*b*, 1104*c*, and 1104*d* may be designed to interface and secure the second corner webbings 506*a*, 506*b*, 506*c*, and 506*d*. As explained earlier, the second corner webbings 506*a*, 506*b*, 506*c*, and 506*d* may be adjoined to the first corner webbings 504*a*, 504*b*, 504*c*, and 504*d*, thereby attaching the sleeping pad 202 to the tent 102.

The positioning of the loops 1104*a*, 1104*b*, 1104*c*, and 1104*d* at the corners of the sleeping pad 202 may provide a secure and stable connection to the tent 102 structure. Such a configuration may help to maintain the proper alignment of the sleeping pad 202 relative to the tent 102 base 302 and may prevent shifting or displacement during use. Additionally, the second corner webbings 506*a*, 506*b*, 506*c*, and 506*d* may distribute tension evenly across the sleeping pad 202, potentially extending its lifespan and maintaining its shape over time.

In some cases, the material composition of the sleeping pad 202 may be selected to provide a balance of comfort, durability, and portability. The sleeping pad 202 may be constructed from materials that are resistant to moisture, easy to clean, and capable of providing adequate insulation from the ground. The combination of the coring hole pattern and the material selection may result in a sleeping pad 202 that is both lightweight and supportive, making it suitable for various environments and use cases within the tent 102.

Figure 12:
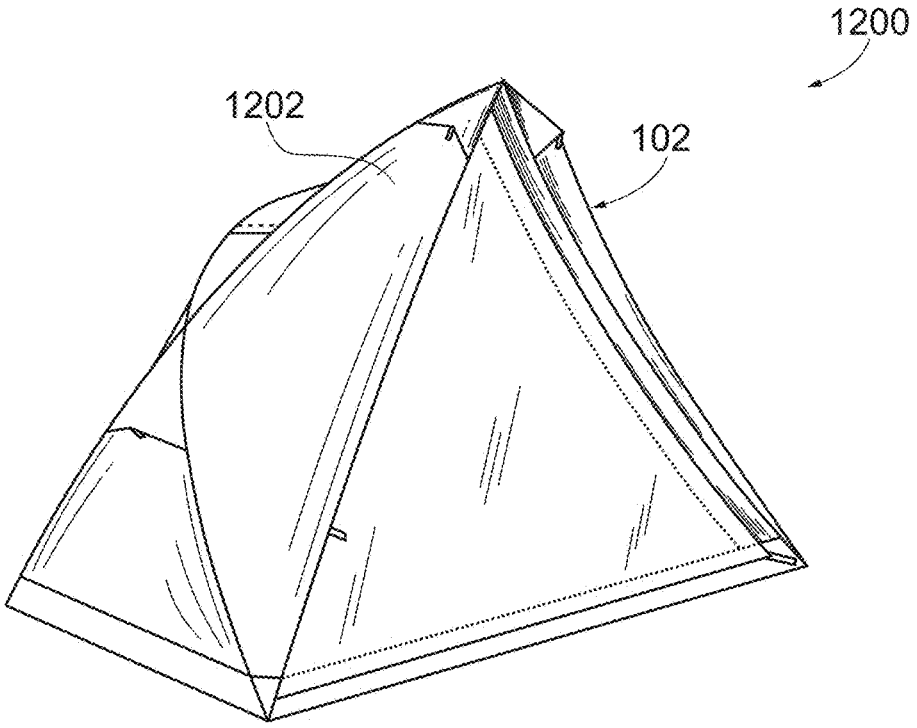
FIG. 12 illustrates a front perspective view of the tent with a blackout cover.
Figure 13:
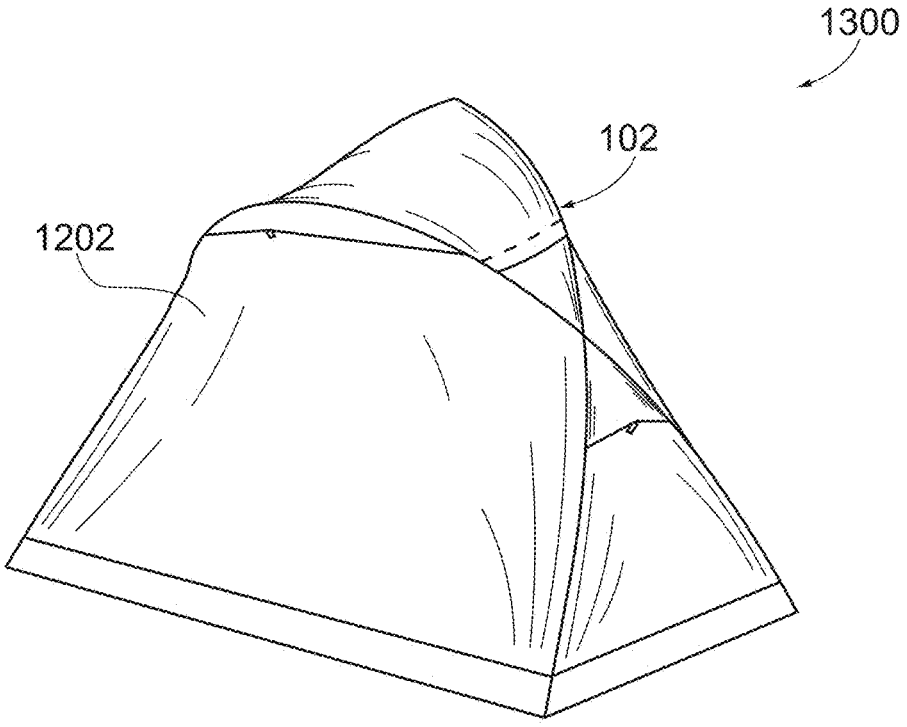
FIG. 13 illustrates a rear perspective view of the tent with the blackout cover.

FIG. 12 illustrates a front perspective view 1200 of the tent 102. FIG. 13 illustrates a rear perspective view 1300 of the tent 102. In an illustrative configuration, the tent 102 may be equipped with a blackout cover 1202.

The blackout cover 1202 may be designed to fit over the exterior of the tent 102, providing complete coverage while maintaining the overall shape and structure of the tent 102 assembly. In some configurations, the blackout cover 1202 may be constructed from a light-blocking material to create a dark environment within the tent 102, which can be beneficial for promoting sleep, especially in environments with varying light conditions. The blackout cover 1202 may include fastening mechanisms along its edges to secure it to the tent 102, such as zippers, hook-and-loop fasteners, snaps, or elastic edges. In one configuration, the blackout cover 1202 is provided with buckles which provide ease of use for parents. In certain configurations, the blackout cover 1202 may incorporate ventilation features to maintain air circulation within the tent 102 while still blocking light. These features may include mesh panels or strategically-placed adjustable vents to allow airflow without compromising the light-blocking capabilities of the cover. The blackout cover 1202 may be removable and packable, allowing for versatility in different environments or situations where light blocking may not be necessary.

The tent 102 may be designed with portability as a key feature, allowing for easy transport and setup in various locations. In some configurations, the tent 102 may be constructed using lightweight materials that contribute to a reduced overall weight, potentially making it easier for caregivers to carry. The collapsible structure 310 may allow the tent 102 to be compactly folded or disassembled, reducing its size for storage and transport in a carrying means, such as a carry bag 1402, which is explained in detail in conjunction with FIGS. 14-15.

Figure 14:
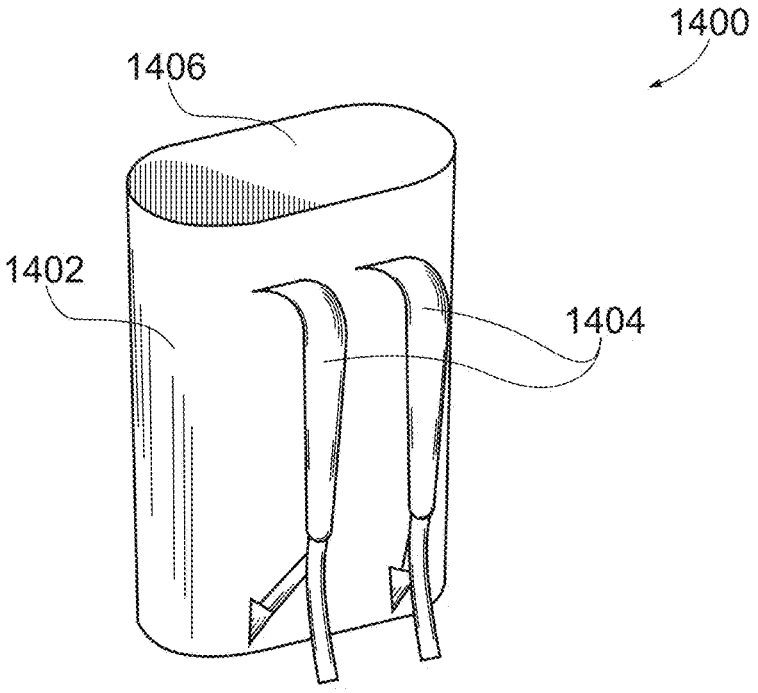
FIG. 14 illustrates a perspective view of a carry bag for the tent.

FIG. 14 illustrates a perspective view 1400 of a carry bag 1402 designed for transporting the tent 102. The carry bag 1402 may be designed to accommodate and transport all components of the tent 102, including the tent 102 structure, sleeping pad 202, and other accessories such as fasteners. In some configurations, the carry bag 1402 may be constructed from durable, water-resistant materials to protect the tent 102 components during transport and storage. The carry bag 1402 may include shoulder straps 1404 attached to its exterior surface, enabling comfortable carrying. A storage 1406 may be formed into the carry bag 1402 to accommodate the tent 102.

Figure 15:
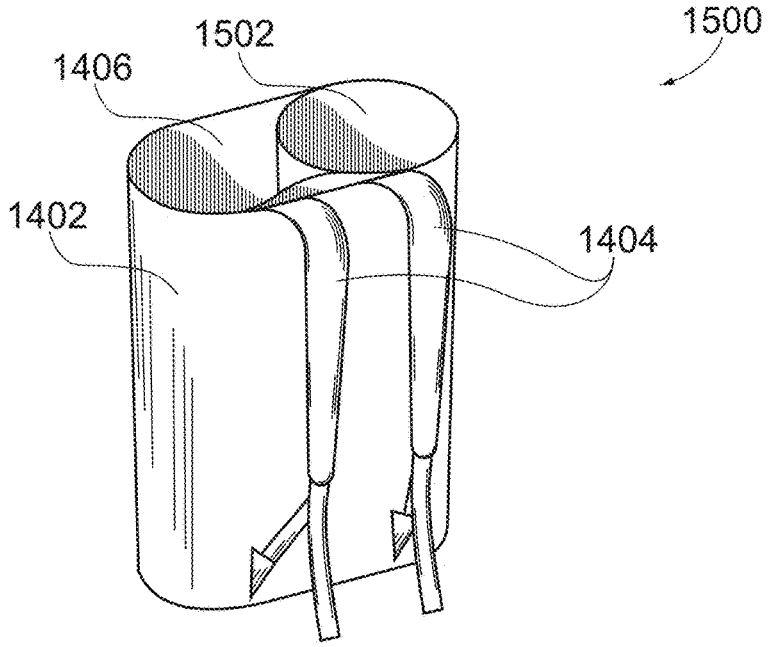
FIG. 15 illustrates a perspective view of the carry bag with sub-storage.

FIG. 15 illustrates a perspective view 1500 of the carry bag 1402. The carry bag 1402 may include shoulder straps 1404 attached to its exterior surface. The carry bag 1402 may comprise a storage 1406 and a sub-storage 1502. The sub-storage 1502 may be integrated into the storage 1406, providing additional organized storage space separate from the storage 1406. In some configurations, the sub-storage 1502 may be designed to hold smaller items such as stakes, guy lines, or the blackout cover 1202, keeping them separate from the larger tent 102 components in the storage 1406. This organization may allow for quicker access to specific items without the need to unpack the entire bag. The carry bag 1402 may also feature additional external pockets or attachment points for items that may need to be accessed frequently or separately from the main tent 102 components.

Figure 16:
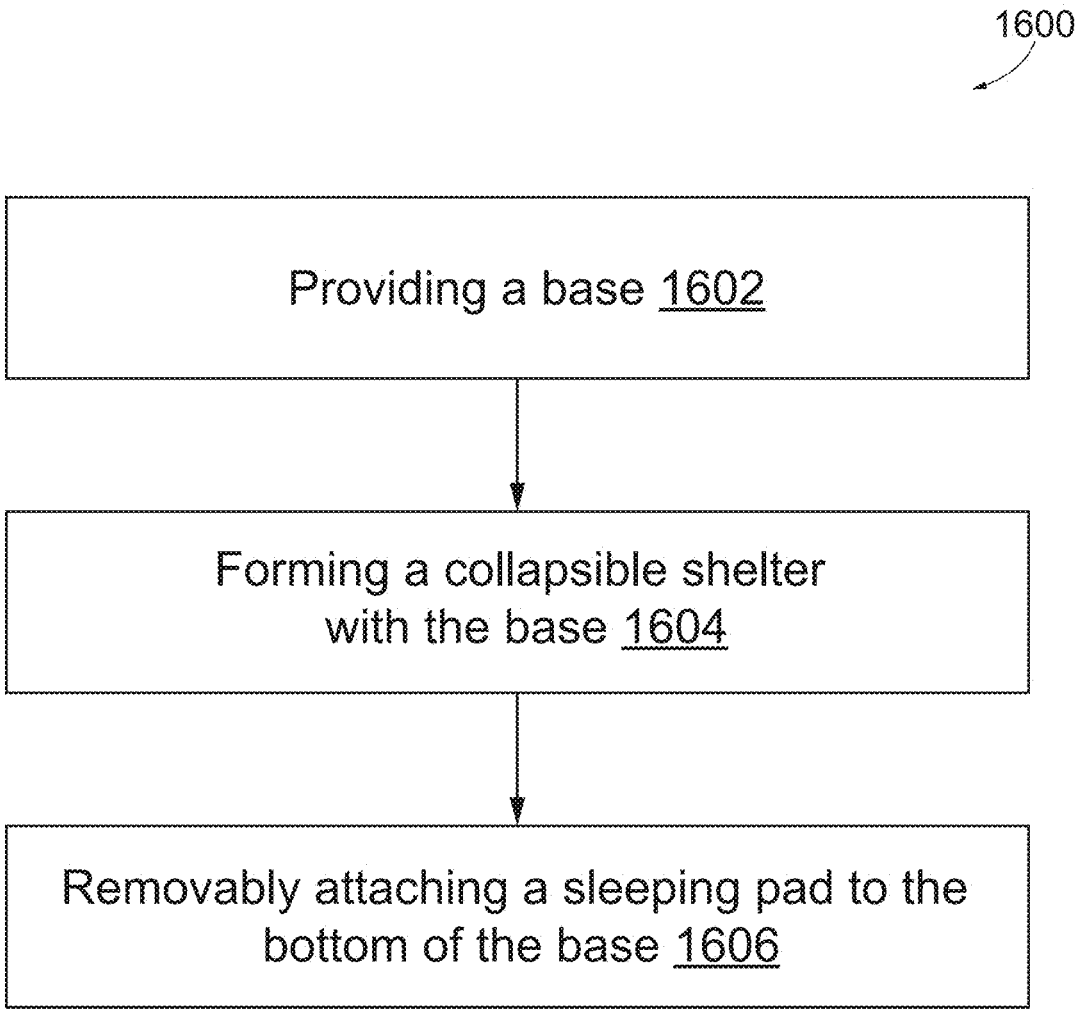
FIG. 16 illustrates a flowchart of a method for assembling a tent.

FIG. 16 illustrates a flowchart of a method 1600 for assembling the tent 102 for children. The method 1600 may include one or more steps 1602, 1604, 1606 that guide users through the complete assembly process. These steps, 1602, 1604, and 1606, are arranged in a logical progression that ensures proper structural integrity and functionality of the tent 102. This systematic approach to assembly helps minimize confusion during setup and ensures that all safety features are properly implemented, which is particularly important for a product designed for use with children. FIG. 16 is explained in conjunction with FIGS. 1-15.

At step 1602, a base 302 may be provided. The base 302 may include a top 304, a bottom 306 oppositely disposed to the top 304, and a border 308 externally formed at the bottom 306. Additionally, in this step 1602, the removable floor panel 802 may be secured within the top 304 of the base 302 using the base zipper mechanism 1002, which incorporates the overlapping terminal design with first terminal 1008 and second terminal 1010 to prevent unauthorized access by children to the base slider 1006.

At step 1604, a collapsible structure 310 may be formed with the base 302. This step 1604 encompasses several sub-actions, including adjoining the plurality of vertical panels 312 to the border 308 of the base 302, attaching the upper canopy 314 to the vertical panels 312, and coupling the pair of poles 316 between the base 302 and the upper canopy 314. The poles 316 are inserted through the pass-through fittings 702*a*, 702*b*, 702*c*, 702*d* at the first corner webbings 504*a*, 504*b*, 504*c*, 504*d*, creating the structural framework of the tent 102. Additionally, the vertical panels 312 may be secured to the poles 316 using the second-type fasteners 416, which helps maintain proper tension throughout the tent 102 and ensures structural stability thereof.

At step 1606, a sleeping pad 202 may be attached to the bottom 306 of the base 302. The sleeping pad 202 may be positioned beneath the tent 102 and secured using the connection between the first corner webbings 504*a*, 504*b*, 504*c*, 504*d* and second corner webbings 506*a*, 506*b*, 506*c*, 506*d* via the first-type fasteners 414. The sleeping pad 202 may be positioned such that a perimeter 322 thereof extends beyond the border 308 of the base 302 by the predefined offset distance "D1", creating the safety zone that prevents child entrapment between the base 302 and the sleeping surface. This configuration ensures that the sleeping pad 202 remains securely attached while maintaining the critical safety feature of the offset perimeter 322.

The method 1600 may be supplemented with additional optional steps, depending on specific usage scenarios. For instance, users may install the blackout cover 1202 over the tent 102 structure to create a darkened interior environment conducive to sleep, particularly useful in environments with varying light conditions. Users may also configure the access door 401 by securing it in either open or closed positions using the door zipper mechanism 402. The zipper garage feature of the door zipper mechanism 402 provides an additional safety element by preventing children from accessing the door slider 406, which could potentially be a choking hazard or allow unauthorized opening of the tent 102.

The complete assembly process results in a fully functional tent 102 that strikes a balance between structural integrity, safety features, and ease of use. The assembled tent 102 provides a secure sleeping environment for children while incorporating multiple safety elements specifically designed to address common concerns such as entrapment risks and access to potentially hazardous components. The modular nature of the assembly process also facilitates disassembly for storage and transport, with all components fitting into the dedicated carry bag 1402, which features storage 1406 and sub-storage 1502. This systematic approach to assembly and disassembly enhances the overall user experience while ensuring consistent implementation of the safety features of the tent 102.

The methods, systems, devices, graphs, and/or tables are illustrative examples, and configurations may omit, substitute, or add various procedures or components as appropriate. For instance, the methods may be reordered in alternative configurations, and/or various stages may be added, omitted, and/or combined. Alternatively, features described with respect to certain configurations may be in various alternative configurations. Different configurations and elements of the configurations may be combined similarly. Also, technology evolves; thus, many of the elements are examples and do not limit the scope of the disclosure or claims. Additionally, the techniques discussed herein may provide differing results with different types of context awareness classifiers.

Unless defined otherwise, all technical and scientific terms used herein have the same meaning as commonly or conventionally understood. As used herein, the articles "a" and "an" refer to one or more than one (i.e., to at least one) of the grammatical object of the article. By way of example, "an element" means one element or more than one element. "About" and/or "approximately" as used herein when referring to a measurable value such as an amount, a temporal duration, and the like encompass variations of +20% or +10%, +5%, or +0.1% from the specified value as such variations are appropriate in the context of the systems, devices, circuits, methods, and other implementations described herein. "Substantially," as used herein when referring to a measurable value such as an amount, a temporal duration, a physical attribute (such as frequency), and the like, also encompasses variations of +20% or +10%, +5%, or +0.1% from the specified value as such variations are appropriate in the context of the systems, devices, circuits, methods, and other implementations described herein.

As used herein, including in the claims, "and" as used in a list of items prefaced by "at least one of" or "one or more of" indicates that any combination of the listed items may be utilized. For example, a list of "at least one of A, B, and C" includes any of the combinations A, B, C, AB, AC, BC, and/or ABC (i.e., A, B, and C). Furthermore, to the extent more than one occurrence or use of the items A, B, or C is possible, multiple uses of A, B, and/or C may form part of the contemplated combinations. For example, a list of "at least one of A, B, and C" may include AA, AAB, AAA, BB, etc.

While illustrative and presently preferred embodiments of the disclosed systems, methods, and/or machine-readable media have been described in detail herein, it is to be understood that the inventive concepts may be otherwise variously embodied and employed and that the appended claims are intended to be construed to include such variations except as limited by the prior art. While the principles of the disclosure have been provided in connection with specific apparatuses and methods, it is to be clearly understood that this description is made only by way of example and not as a limitation on the scope of the disclosure.

What is claimed is:

1. A tent for children, comprising:

a base comprising:

a top;

a bottom oppositely disposed to the top; and a border externally formed at the bottom;

a collapsible shelter formed with the base, the collapsible shelter comprising:

a plurality of vertical panels adjoined to the border of the base;

an upper canopy attached to the plurality of vertical panels; and a pair of poles, each pole extending between, and coupled to, the base and the upper canopy;

a sleeping pad removably adjacent to the bottom of the base, the sleeping pad comprising:

an upper surface attached to the bottom of the base;

a bottom surface oppositely disposed to the upper surface; and a perimeter enclosing the upper surface and the bottom surface, wherein the perimeter of the sleeping pad is outwardly offset to the border of the base by a predefined distance configure to prevent entrapment of a child between the bottom of the base and the sleeping pad; and a removable floor panel secured within the top of the base using a base zipper mechanism, wherein the base zipper mechanism comprises:

a base zipper chain and a base slider sliding thereon, the base zipper chain comprising:

a first terminal to house the base slider; and a second terminal, wherein the base zipper chain at the second terminal overlaps the first terminal by a predefined distance configured to prevent access to the base slider.

2. The tent of claim 1 and further comprising:

an access door removably formed with any one panel from plurality of vertical panels via a door zipper mechanism, wherein the door zipper mechanism comprises:

a door zipper chain and a door slider sliding thereon, the door zipper chain comprising:

a first zipper end; and a second zipper end, wherein any one of the first zipper end and the second zipper end is equipped with a zipper garage to enclose the door slider.

3. The tent of claim 1 and further comprising:

a plurality of first corner webbings, wherein each first corner webbing extends from each corner of the border of the base;

a plurality of second corner webbings, wherein each second corner webbing extends from each corner of the perimeter of the sleeping pad, wherein each first corner webbing is removably adjoined to each second corner webbing; and a pass-through fitting formed at each first corner webbing from the plurality of first corner webbings.

4. The tent of claim 3, wherein consecutive ends of each pole engage with consecutive pass-through fittings to provide structural support to the collapsible shelter.

5. The tent of claim 1 and further comprising:

a plurality of first fasteners adjoined each vertical panel of the plurality of vertical panels, wherein the plurality of first fasteners are removably engaged with each pole from the pair of poles to couple the plurality of vertical panels to the pair of poles.

6. The tent of claim 1, wherein each vertical panel from the plurality of vertical panels comprises:

an interior surface; and an exterior surface opposite to the interior surface, wherein at least one of the interior surface and at least one of the exterior surface comprises:

one or more storage pockets.

7. A method of assembling a tent for children, the method comprising:

providing a base comprising:
a top;
a bottom oppositely disposed to the top; and
a border externally formed at the bottom;
forming a collapsible shelter with the base, the collapsible shelter comprising:
a plurality of vertical panels adjoined to the border of the base;
an upper canopy attached to the plurality of vertical panels; and
a pair of poles, each pole extending between and coupled to the base and the upper canopy;
removably attaching a sleeping pad to the bottom of the base, the sleeping pad comprising:
an upper surface attached to the bottom of the base;
a bottom surface oppositely disposed to the upper surface; and
a perimeter enclosing the upper surface and the bottom surface,
wherein the perimeter of the sleeping pad is outwardly offset to the border of the base by a predefined distance to prevent entrapment of a child between the bottom of the base and the sleeping pad; and
securing a removable floor panel within the top of the base using a base zipper mechanism, wherein the base zipper mechanism comprises:
a base zipper chain and a base slider sliding thereon, the base zipper chain comprising:
a first terminal to house the base slider; and
a second terminal, wherein the base zipper chain at the second terminal overlaps the first terminal by a predefined distance to prevent access to the base slider.

8. The method of claim 7 and further comprising:
forming an access door with any one panel from plurality of vertical panels via a door zipper mechanism, wherein the door zipper mechanism comprises:
a door zipper chain and a door slider sliding thereon, the door zipper chain comprising:
a first zipper end; and
a second zipper end,
wherein any one of the first zipper end and the second zipper end is equipped with a zipper garage to enclose the door slider.

9. The method of claim 7 and further comprising:
providing a plurality of first corner webbings, wherein each first corner webbing extends from each corner of the border of the base;
providing a plurality of second corner webbings, wherein each second corner webbing extends from each corner of the perimeter of the sleeping pad,
wherein each first corner webbing is removably adjoined to each second corner webbing; and
forming a pass-through fitting at each first corner webbing from the plurality of first corner webbings.

10. The method of claim 9, further comprising engaging consecutive ends of each pole with consecutive pass-through fittings to provide structural support to the collapsible shelter.

11. The method of claim 7 and further comprising:
providing a plurality of first fasteners adjoined each vertical panel of the plurality of vertical panels, wherein the plurality of first fasteners are removably engaged with each pole from the pair of poles to couple the plurality of vertical panels to the pair of poles.

12. The method of claim 7, wherein each vertical panel from the plurality of vertical panels comprises:
an interior surface; and
an exterior surface opposite to the interior surface, wherein at least one of the interior surface and at least one of the exterior surface comprises:
one or more storage pockets.

13. A tent for children, comprising:
a base comprising:
a top;
a bottom oppositely disposed to the top; and
a border externally formed at the bottom;
a collapsible shelter formed with the base, the collapsible shelter comprising:
a plurality of vertical panels adjoined to the border of the base;
an upper canopy attached to the plurality of vertical panels; and
a pair of poles, each pole extending between, and coupled to the base and the upper canopy; and
a removable floor panel secured within the top of the base using a base zipper mechanism, wherein the base zipper mechanism comprises:
a base zipper chain and a base slider sliding thereon, the base zipper chain comprising:
a first terminal to house the base slider; and
a second terminal, wherein the base zipper chain at the second terminal extends over the first terminal by a predefined distance to prevent access to the base slider.

14. The tent of claim 13 and further comprising:
a sleeping pad removably attached to the bottom of the base, the sleeping pad comprising:
an upper surface attached to the bottom of the base;
a bottom surface oppositely disposed to the upper surface; and
a perimeter enclosing the upper surface and the bottom surface;
wherein the perimeter of the sleeping pad is outwardly offset to the border of the base by a predefined distance to prevent entrapment of a child between the bottom of the base and the sleeping pad.

15. The tent of claim 14 and further comprising:
a plurality of first corner webbings, wherein each first corner webbing extends from each corner of the border of the base;
a plurality of second corner webbings, wherein each second corner webbing extends from each corner of the perimeter of the sleeping pad,
wherein each first corner webbing is removably adjoined to each second corner webbing; and
a pass-through fitting formed at each first corner webbing from the plurality of first corner webbings.

16. The tent of claim 15, wherein consecutive ends of each pole engage with consecutive pass-through fittings to provide structural support to the collapsible shelter.

17. The tent of claim 13 and further comprising:
a plurality of first fasteners adjoined each vertical panel of the plurality of vertical panels, wherein the plurality of first fasteners are removably engaged with each pole from the pair of poles to couple the plurality of vertical panels to the pair of poles.

18. The tent of claim 13 and further comprising:
an access door removably formed with any one panel from plurality of vertical panels via a door zipper mechanism, wherein the door zipper mechanism comprises:
a door zipper chain and a door slider sliding thereon, the door zipper chain comprising:

a first zipper end; and a second zipper end, wherein any one of the first zipper end and the second zipper end is equipped with a zipper garage to enclose the door slider.

* * * * *